US006199545B1

(12) United States Patent
Adamson

(10) Patent No.: US 6,199,545 B1
(45) Date of Patent: Mar. 13, 2001

(54) ENGRAVING APPARATUS AND METHOD

(76) Inventor: Darrel M. Adamson, 918 Plum Tree La., Sarasota, FL (US) 34243

( * ) Notice: Subject to any disclaimer, the term of this patent is extended or adjusted under 35 U.S.C. 154(b) by 0 days.

(21) Appl. No.: 09/294,988

(22) Filed: Apr. 19, 1999

(51) Int. Cl.[7] ..... B28D 1/26
(52) U.S. Cl. ..... 125/41; 125/30; 125/23.01
(58) Field of Search ..... 451/29, 30, 445; 125/23.01, 41, 40, 30

(56) References Cited

U.S. PATENT DOCUMENTS

| | | | | |
|---|---|---|---|---|
| 3,344,868 | * | 10/1967 | Mikiya et al. | 125/23.01 |
| 3,915,061 | * | 10/1975 | Stockman | 90/11 C |
| 4,132,151 | * | 1/1979 | Weber | 90/13.05 |
| 4,624,609 | * | 11/1986 | Pickett | 409/96 |
| 4,954,192 | * | 9/1990 | Dziekan | 125/23.01 |
| 5,038,714 | | 8/1991 | Dye et al. . | |
| 5,133,621 | | 7/1992 | Gonzales . | |
| 5,176,426 | | 1/1993 | Adamson . | |
| 5,243,905 | | 9/1993 | Webber . | |
| 5,445,437 | | 8/1995 | Adamson . | |
| 5,447,752 | | 9/1995 | Cobb . | |
| 5,735,094 | | 4/1998 | Zember . | |
| 5,792,511 | | 8/1998 | Oliver et al. . | |

OTHER PUBLICATIONS

Puma Air Tools Inc., on–line catalog sheet (http://www.pumaair.com/p20.html), Jan. 29, 1999.

Texas Pneumatic Tools, Inc., on–line catalog sheet (http://www.airtools.com/needle.html), pp 1–4, Jan. 29, 1999.

Superior Pneumatic, Inc., on–line catalog (http://www.superiorpneumatic.com/ps2.htm), pp 1–2, Jan. 29, 1999.

* cited by examiner

*Primary Examiner*—Derris H. Banks
*Assistant Examiner*—Lee Wilson
(74) *Attorney, Agent, or Firm*—David Kiewit

(57) ABSTRACT

Arrangements are taught for decoratively engraving a surface, such as hardened concrete or stone, particularly by engraving stencil-defined swaths into the surface with a tool of the type commonly called a needle scaler. The arrangements include methods of covering portions of the surface with a stencil made of material capable of withstanding a chisel blow, and then engraving exposed swaths by repeated chisel blows from one or more chisels having a restricted stroke. In some cases non-contiguous portions of a stencil are interconnected by bridge-line connectors selected to allow free access to the entire swath by a needle scaler or other chisel driving apparatus. In other cases a space-frame is placed atop a stencil and used to support discrete non-contiguous island portions of the stencil.

13 Claims, 7 Drawing Sheets

16
10
54
52
50
53
54
56
56
38
18
12
22
24
14
26

ENGRAVING APPARATUS AND METHOD

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The invention relates to the art of engraving a surface, often for the purpose of providing a decorative design on a previously hardened concrete, asphalt or other workable surface.

2. Background Information

Many earlier inventors have taught methods of concrete decoration in which a stencil is laid on a concrete surface and wet, colored concrete materials are added to the pre-existing surface through holes in the stencil. Notable among teachings in this area are the following patents:

- U.S. Pat. No. 5,792,511, wherein Oliver et al. show a stencil that remains embedded in the decorative coating.
- U.S. Pat. No. 5,735,094, wherein Zember describes a coating process using specific materials and involving pulling a stencil out of the coating before it sets up.
- U.S. Pat. No. 5,447,752, wherein Cobb describes a similar process using different materials.
- U.S. Pat. No. 5,243,905, wherein Webber teaches a stencil comprising interlocking segments and used in a coating process.
- U.S. Pat. No. 5,133,621, wherein Gonzales describes a way of putting isolated decorative figures in a wet concrete slab.
- U.S. Pat. No. 5,038,714, Dye et al. teach an arrangement for spraying a dye, but not additional concrete, through a stencil having a gasket on the bottom thereof.

The inventor, in his U.S. Pat. No. 5,176,426 and U.S. Pat. No. 5,445,437, has taught method and apparatus for engraving decorative figures into a hardened concrete surface by guiding a cutting apparatus across the surface to be decorated. These arrangements have generally employed small wheeled carts carrying abrasive grinding wheels.

Apparatus of the sort generally referred to as "flux chippers" or "needle scalers" is also of interest. In these sorts of apparatus one or more impacting tools, retained for translational motion of a limited extent along a predetermined axis, are repeatedly driven into the surface to be engraved by impacts from a hammer that is conventionally pneumatically operated, but that could be electrically or hydraulically driven. A needle scaler typically uses ten to thirty pointed rods, called "needles", as the impacting tools. Each of these needles may have a diameter of two to three millimeters and commonly has a nail-head end distal from the pointed or beveled work-impacting end that commonly projects outwardly from a nosepiece of the apparatus. A pneumatically driven hammer head strikes the array of needles and is returned to the beginning of its reciprocating stroke by a return spring. This arrangement provides several thousand blows per minute on the array of nail heads and thereby repeatedly drives the needles back and forth over a total stroke distance of some three centimeters. Needle scalers are generally used in a freehand mode and are made with a variety of grips and nose configuration to adapt them to differing applications. The uses for needle scalers include cleaning rust (e.g., mill scale) from iron and steel castings, peening welded joints, removing barnacles from marine apparatus, and chipping stone, concrete and brick.

In addition to the use of grinding wheels and of chisels, it is also known to engrave hard surfaces by sandblasting, shot peening and other such techniques in which impacting tools, comprising small particles of a hard material, are expelled from the nose or nozzle of a tool driving or dispensing means and energetically impact a surface being engraved. When used to make deep cuts in hardened concrete or other aggregate materials comprising segregated portions of differing hardness, sandblasting leads to an engraved region having a rough texture because the softer portions of the concrete are removed more easily than harder ones.

BRIEF SUMMARY OF THE INVENTION

A preferred embodiment of the invention provides apparatus for engraving a hardened surface of stone, concrete, asphalt, or the like. This apparatus may comprise one or more impacting tools, retained for translational motion of a limited extent along a predetermined axis; as well as an impact-absorbing stencil exposing those regions of the surface to be engraved while protecting adjacent regions from the impacting tools. In some embodiments, the apparatus comprises a plurality of impacting tools protruding outwardly of an aperture having a selectively alterable shape. This allows an operator to select a relatively elongated and narrow aperture when engraving a narrow swath and to select a relatively equi-axial aperture when engraving broader expanses.

In some embodiments, the apparatus of the invention comprises a stencil defining one or more relatively narrow swaths of exposed surface. In some cases, a swath is bordered by a stencil frame or by one of a plurality of non-contiguous "islands" covering portions of the surface that are not to be worked by the tool. In other cases, a swath may be exposed by a slit cut into a single sheet of material used for the stencil. In embodiments having islands, and in some embodiments having a plurality of long slits, bridge-like members may be used to connect adjacent portions of the stencil. In some embodiments these bridges allow engraving of the surface immediately beneath them. This is sometimes done by providing a clearance above the center of the respective exposed swath that is greater than the minimum diameter of the nose of a needle scaler, so that the scaler can be used to engrave that portion of the swath beneath the bridge. In other embodiments, stanchion portions of a bridge are hingedly connected to each of two non-contiguous portions of the stencil so that the bridge can be pivoted from side to side in order to provide an operator with access to the entire swath being engraved. In still other embodiments, one or more of the islands are connected to a space frame disposed on and extending outward from that side of the stencil distal from the engraved surface by connecting means preferably selected to allow a chiseling apparatus or needle scaler free access to all portions of the exposed swaths.

The invention provides methods for decoratively engraving a surface, such as hardened concrete or stone. In some embodiments the invention provides a method of engraving a surface by cutting stencil-defined swaths into the surface. This method may comprise the steps of covering portions of the surface with stencil material capable of withstanding a chisel blow, the spaces between adjacent stencil portions defining the swaths; and to then engrave the swaths by repeated chisel blows from one or more chisels having a restricted stroke. In some of these embodiments the method further comprises attaching non-contiguous portions of stencil material to each other by connecting means selected to allow free access to the entire swath by a needle scaler or other chisel driving apparatus.

Although it is believed that the foregoing recital of features and advantages may be of use to one who is skilled in the art and who wishes to learn how to practice the invention, it will be recognized that the foregoing recital is not intended to list all of the features and advantages of the invention. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

Figure 1:
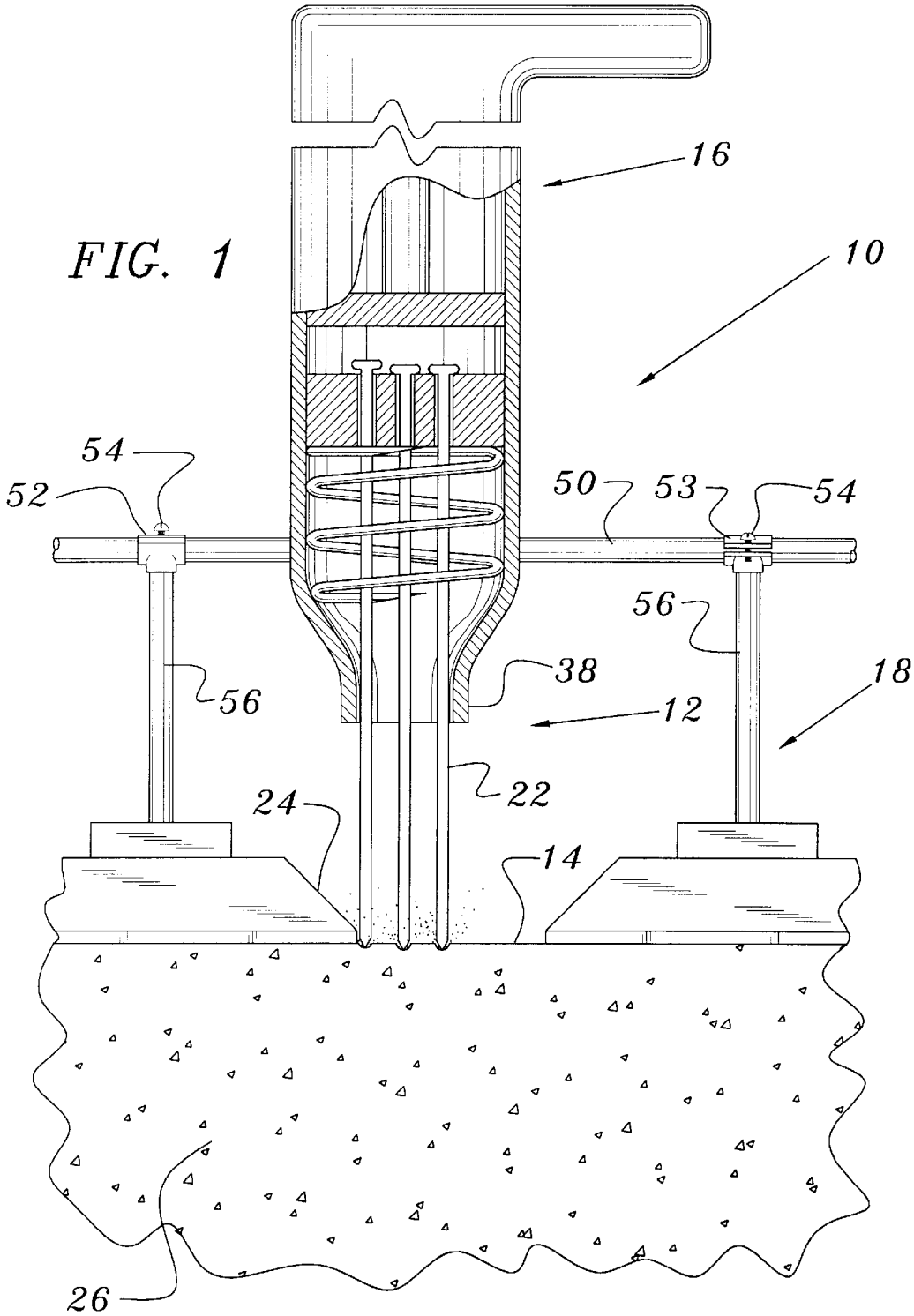
FIG. 1 is a partly cut-away view of a pneumatic needle scaler engraving an exposed concrete swath between two portions of a stencil separately connected to a space frame attached to the side of the stencil distal from the concrete.

Turning initially to FIG. 1, one finds preferred engraving apparatus 10 comprising a plurality of impacting tools 12 adapted to be repeatedly driven into a worked surface 14 by a hammer apparatus 16 that reciprocates the impacting tools 12 along a stroke having a predetermined length. The preferred apparatus 10 also comprises a stencil 18 used to define a swath 20 of the surface 14 to be chased or grooved in the engraving operation. The stencil 18 also protects other portions of the surface from being struck by a scaling needle 22, chisel, or other impacting tool 12. Particularly when a narrow swath 20 is to be chased, portions (which may be discrete portions, as will hereinafter be disclosed) of the preferred stencil 18 may have a beveled periphery 24 slanted so as to guide a reciprocating needle 22 onto the worked swath 20. When a wider swath 20 is being cut a beveled edge 24 is less important because an operator can usually tilt the needles or other impacting tool 12 so as to work close to the edge of the stencil 18. In many embodiments, portions of the stencil 18 adjacent the swath 20 are chosen to be of a material that can sustain repeated blows from a scaling needle 22, pneumatically driven chisel, and the like. In various embodiments, resilient stencil portions may be cut from sheets of plywood, metal, or recycled plastic.

Figure 14:
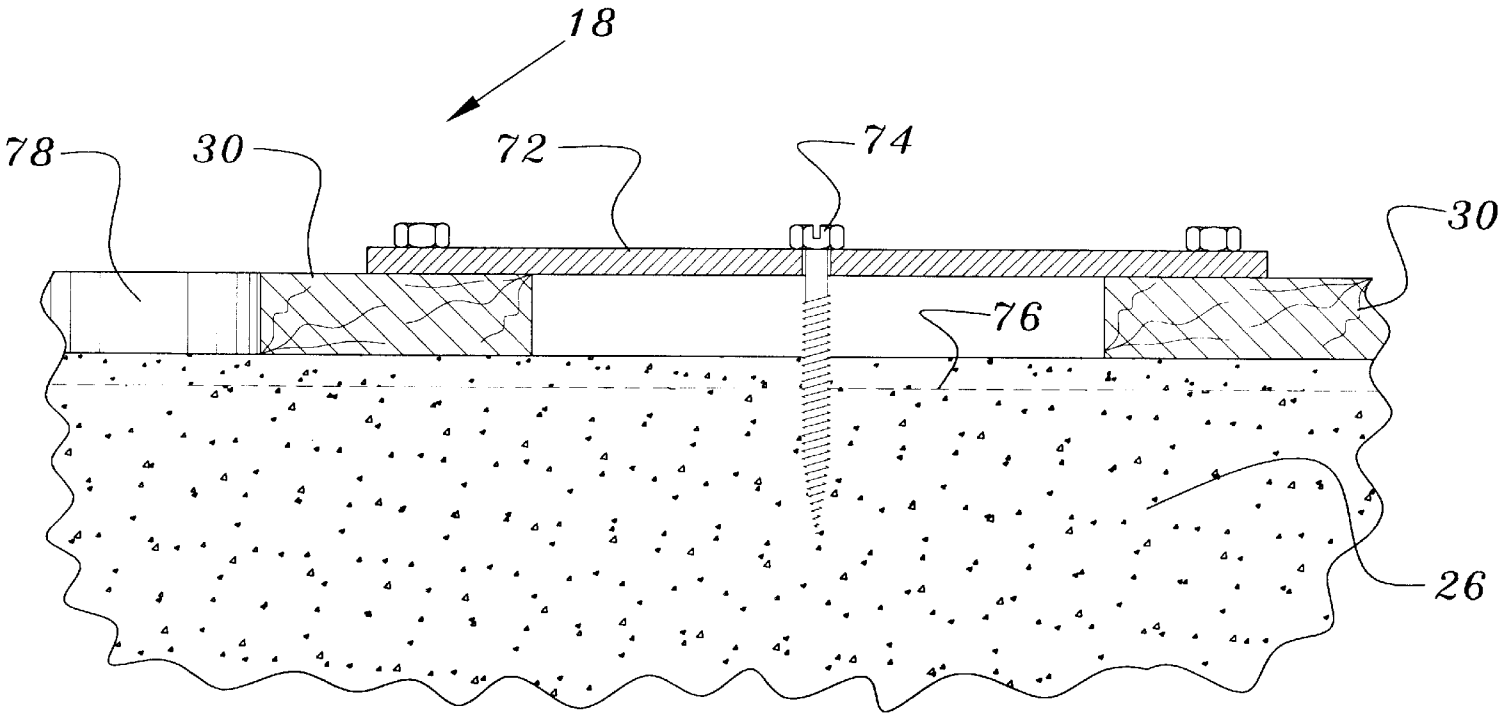
FIG. 14 is a cross section taken perpendicular to a surface to be engraved and through a masking connector connecting two portions of a stencil.

The engraving apparatus 10 may be used for forming surfaces simulative of brick or field stone surfaces by dyeing a concrete surface and then patterning the surface by cutting swaths, simulative of grout lines, to a depth greater than that of the dye penetration, as is indicated with the reference numeral 76 in FIG. 14. Other methods of preparing such simulative surfaces have previously taught in my patents U.S. Pat. No. 5,176,426 and U.S. Pat. No. 5,445,437, the teachings of which are incorporated by reference herein. Thus, it is expected that in most cases the worked surface 14 will be a flat, most commonly horizontally disposed surface of a hardened concrete slab 26, such as a driveway into which a brick-like pattern is to be engraved. The invention, however, is not limited to this case, and may also embrace engraving on curbs 28, other curved surfaces, or on a wall or ceiling. Moreover, the worked surface 14 need not be an exposed surface of a body of pre-hardened concrete, but can be stone, asphalt, glass, or any other material that can be engraved by using an impacting tool to remove a selected portion of the surface thereof.

Figure 2:
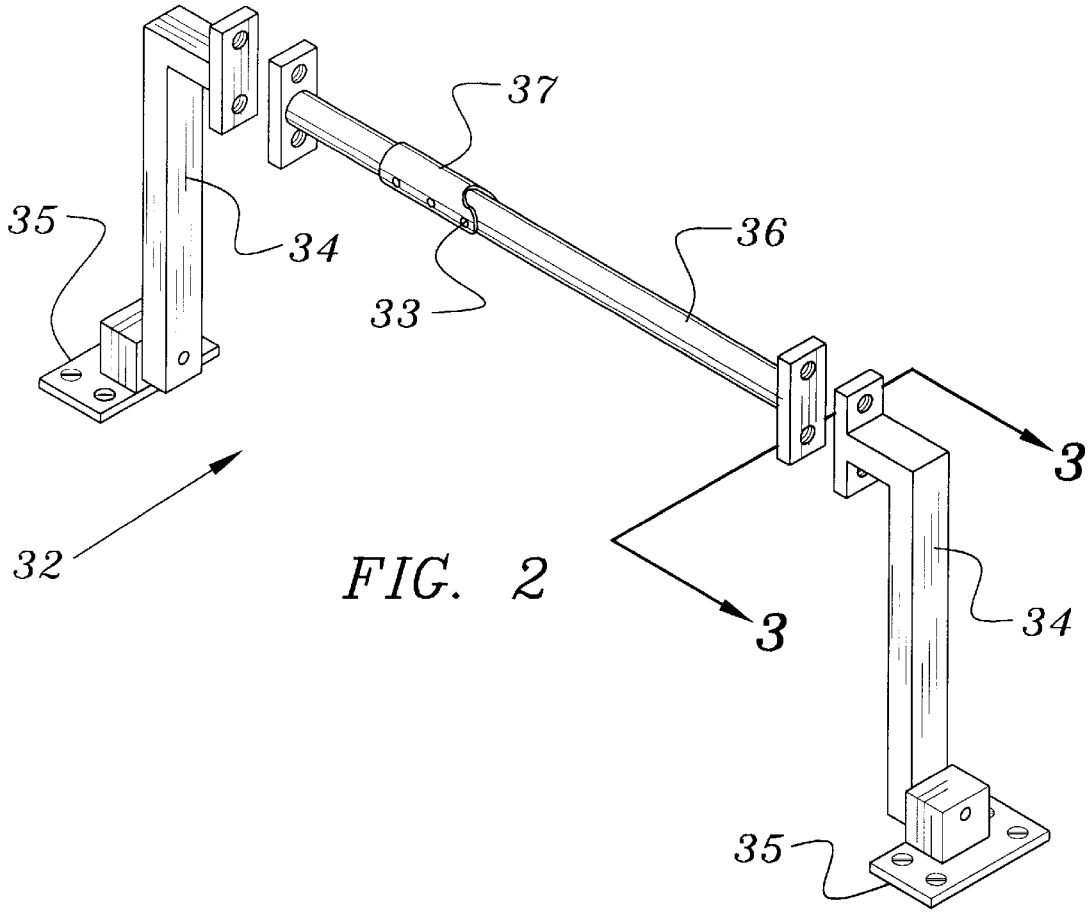
FIG. 2 is an exploded view of a two-legged stencil bridge of the invention
Figure 3:
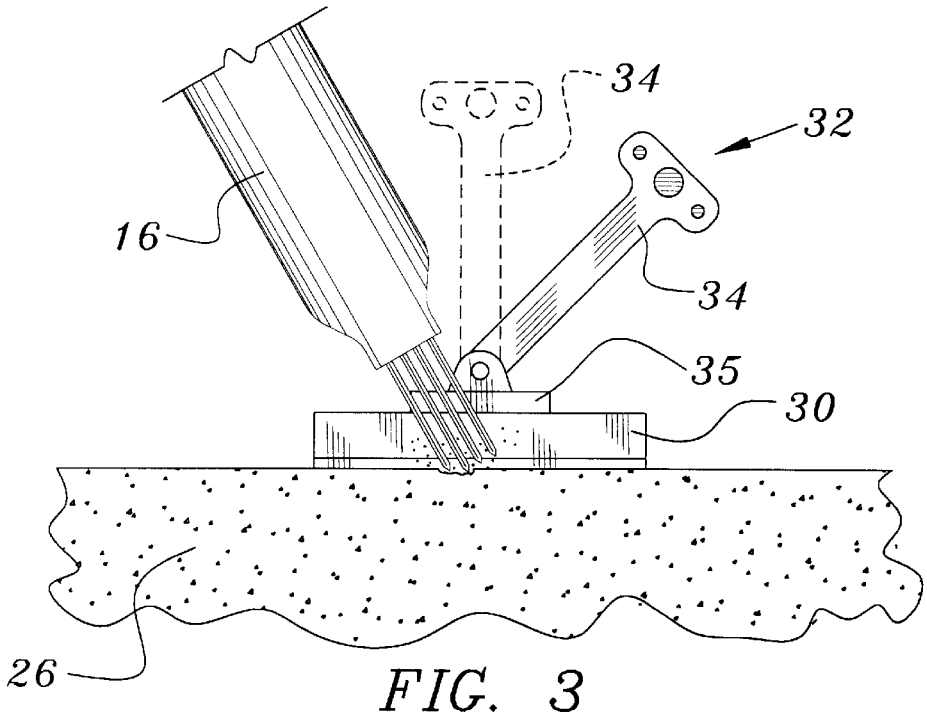
FIG. 3 is a partly sectional side view, similar to one taken along the line 3—3 of FIG. 2, of engraving apparatus being used with a bridged stencil.
Figure 4:
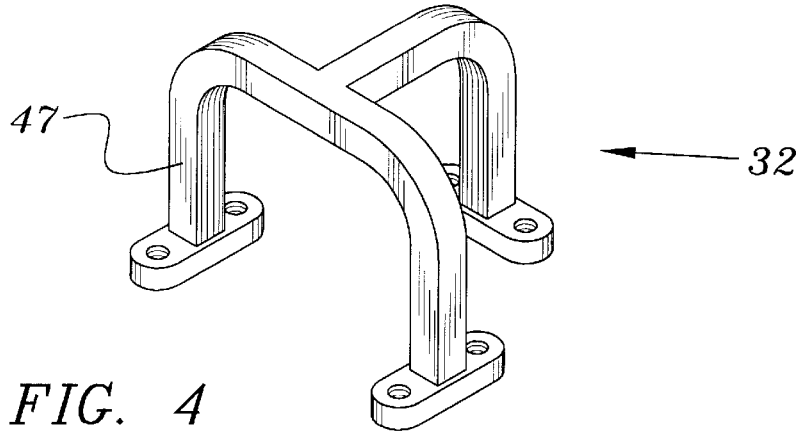
FIG. 4 is a perspective view of a three-legged embodiment of a stencil bridge of the invention.
Figure 5:
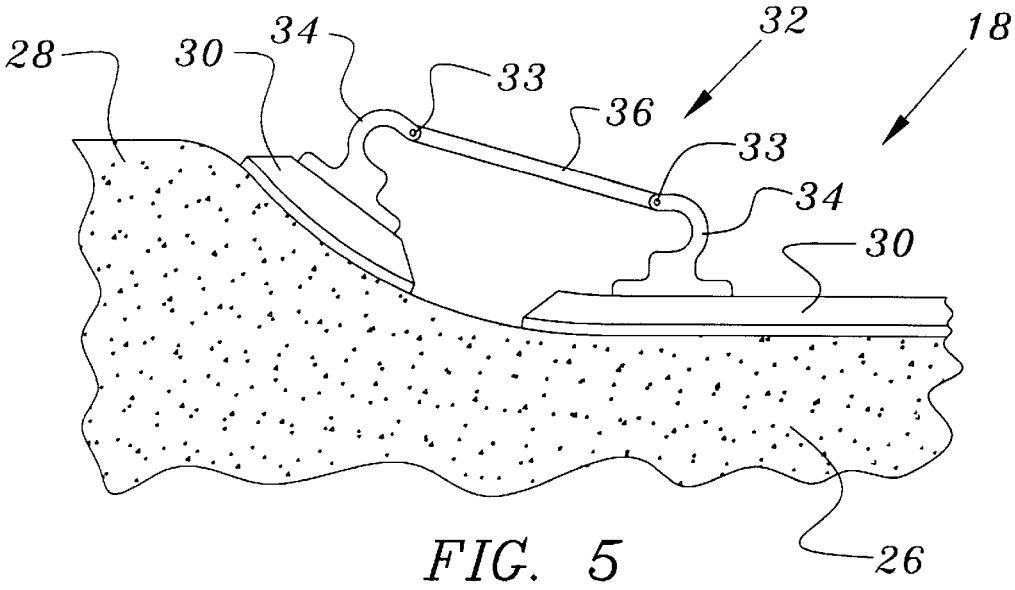
FIG. 5 is a side elevational view of a bridged stencil of the invention used on a curved surface.
Figure 10:
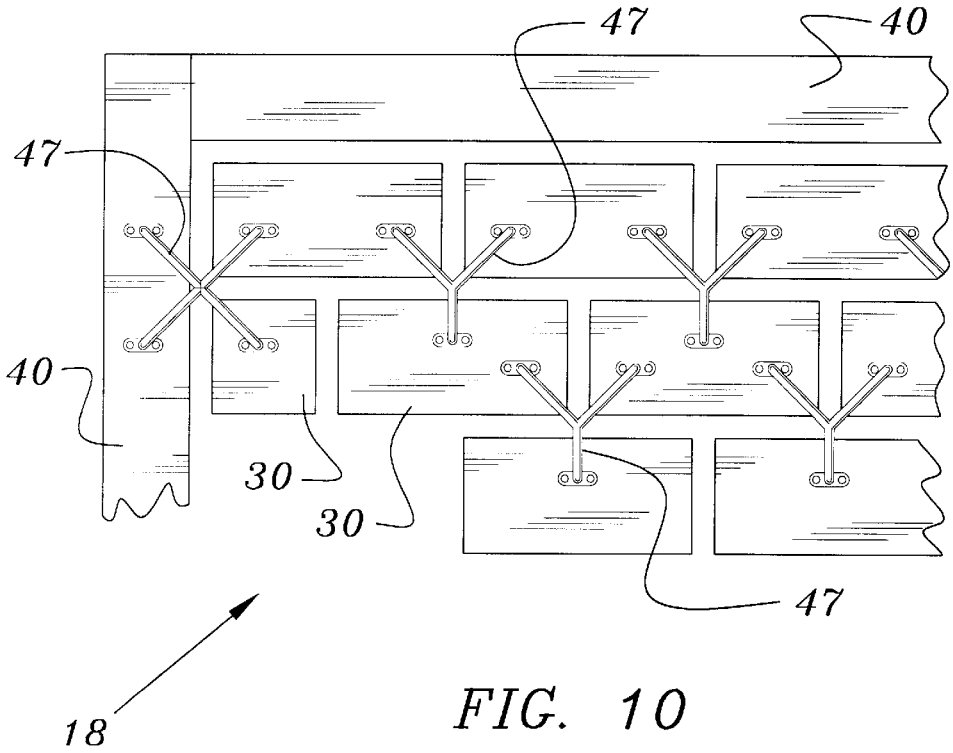
FIG. 10 is a plan view of a stencil comprising three- and four-legged bridges.
Figure 11:
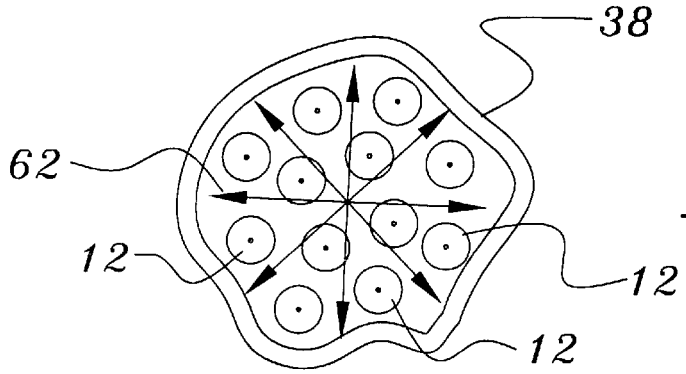
FIG. 11 is an elevational view of a flexible nosepiece in a relaxed state.
Figure 12:
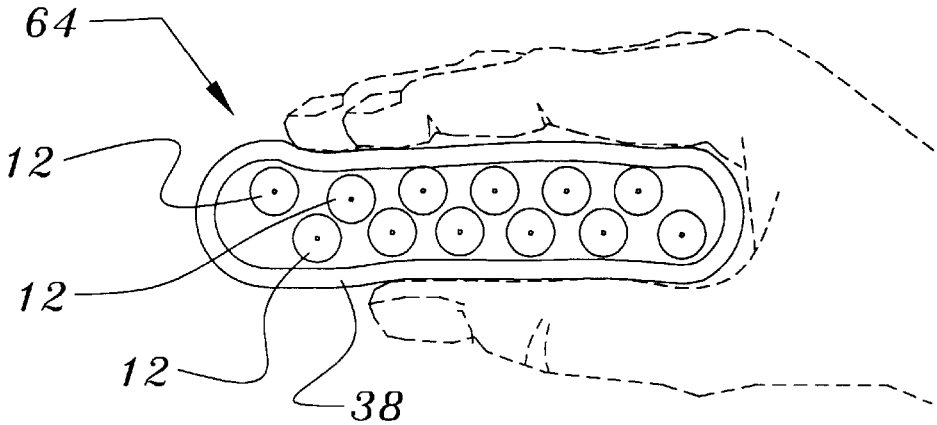
FIG. 12 is an elevational view of the nosepiece of FIG. 11 pinched into a narrow configuration.
Figure 13:
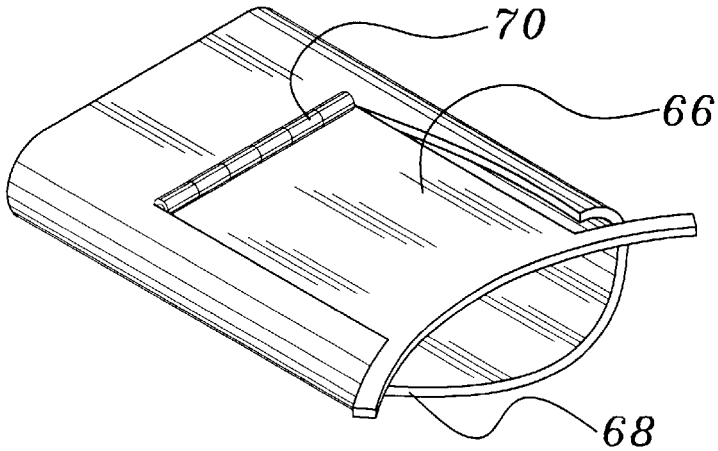
FIG. 13 is a perspective view of a hinged nosepiece for a needle scaler.

Turning now to FIG. 5, one finds a stencil 18 comprising two adjacent, non-contiguous masking elements 30 connected by a bridge 32. The bridge 32 of FIG. 5 comprises stanchions 34 fixedly attached to each of the masking elements and a linking member 36 pivotally connecting the stanchions 34 so as to allow the overall stencil 18 to conform to non-planar portions of the worked surface 14. Although two hinged attachment points are depicted in FIG. 3, it may be noted that a single hinged connection point 33, as depicted in FIG. 2, may well be adequate. Although most of the bridges illustrated in the drawing have two legs, in some cases one can profitably reduce the number of bridges 32 required for a stencil 18 by using a bridge having three or more legs 47, as generally depicted in FIGS. 4 and 10.

Figure 6:
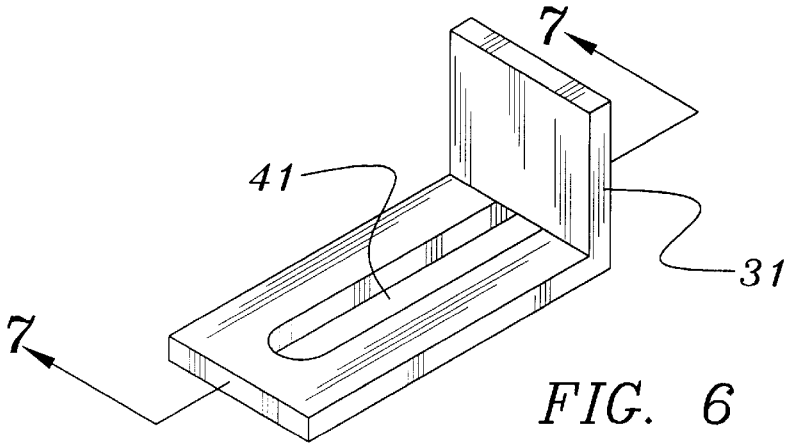
FIG. 6 is an elevational view of a stencil usable for engraving near a vertical wall.
Figure 7:
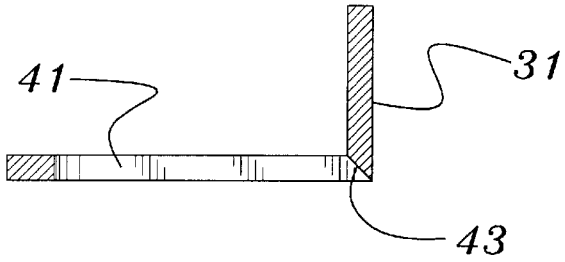
FIG. 7 is a cross sectional view, taken as indicated by 7—7 in FIG. 6, of the stencil of FIG. 6.

When a brick or tile surface is being simulated by engraving pseudo-grout lines into a concrete surface, it is often desired that swaths be engraved up to a wall abutting the surface. In such cases one can employ a generally ell-shaped inside corner stencil 31, as depicted in FIGS. 6 and 7. A preferred inside corner stencil 31 has a slot 41 cut through a leg thereof, with the width of the slot 41 selected to match the width of the swath to be engraved. The slot 41 terminates with an undercut beveled edge portion 42 that allows the scaler needles 22 to reach all the way to the wall without marking the wall. It will be understood to those skilled in the art that if one desires to carry a simulated grout line up along the vertical wall one could use an angled stencil (not shown) having two slotted legs and being similar in appearance to a corner bracket.

In some embodiments the stanchions 34 are selected to be tall enough so the portion of the swath 20 beneath the bridge 32 can be engraved by the impacting tools 12. In these embodiments the clearance, as measured along a line perpendicular to the worked surface 14, between the surface 14 and the bridge 32 is greater than a diameter of the nose 38 of the hammer apparatus 16 or other tool. In other embodiments the stanchions 34 are hingedly attached to a base 35 portion of the bridge 32 so that the bridge 32 can be pivoted out of the way of the hammer apparatus 16, as depicted in FIG. 3. Moreover, a bridge 32 may comprise stanchions 34 linked by a linking member 36 having a length-extensible portion 37 so as to allow for appropriate selection of the widths of swaths to be engraved.

Although the ability to engrave a shadowed portion of a swath disposed along a line running between the ends of by a bridge or other connecting member is important for some applications, this is not universally the case. In some cases it is necessary, or at least convenient, to attach the stencil 18 to a worked surface 14, such as a vertical wall. When engraving to remove a dyed portion having a limited depth 76, it is desirable to avoid marring the masked dyed portion. If one were to simply attach a stencil to a surface by making temporary mounting holes in masked regions, after the engraving was completed one would then have to both fill those holes and dye the filler material to match the surrounding surface. This commonly results in visually obvious and undesired marks on the surface. Hence a preferred approach is to attach a stencil 18 to a worked surface 14 by means of a plurality of screws 74 extending through respective throughholes formed in bridges 32 or in flat, shadowing, connecting members 72. By using this approach, one assures that the subsequent mounting hole patches can be made without having to match dye coloration. In situations where a narrow, grout-line simulative, swath is cut, the resultant patched hole is nearly invisible.

The use of temporary mounting screws necessarily obscures part of the surface to be engraved. In some cases, e.g., when an engraved figure is substantially wider than the impacting tool 12 and when a tall enough bridge 32 is used so that only that portion of the surface immediately adjacent the mounting screw 74 is not worked while the bridge is in place, freehand engraving can be used to finish up around the patched mounting hole. When narrow swaths are being engraved, however, a separate single-slotted stencil having a slot width matching the swath width (such as that shown in FIG. 6) can be used to engrave shadowed regions. Alternately, one can provide a set of slots 78 in masking portions 30 of the stencil, where all of the slots 78 are located the same distance from a mounting hole so that after removing the mounting screws, an operator can translate the entire stencil to one side or another to align the slots 78 with the previously shadowed portions of the worked surface14.

Figure 8:
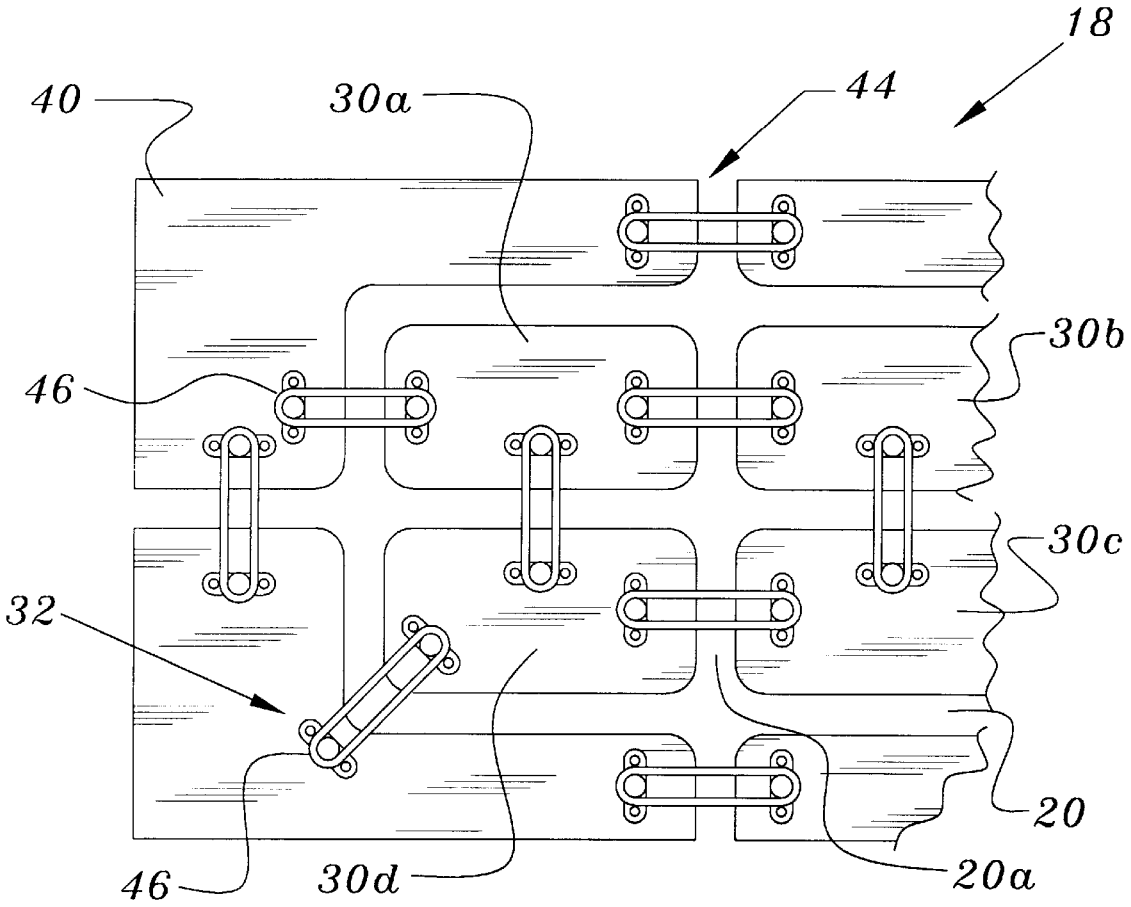
FIG. 8 is a partial plan view of a stencil comprising means of adjusting a swath width.

In some embodiments the stencil 18 may comprise a frame portion 40 surrounding a portion of a surface 14. This frame 40 comprises a large aperture 42 within which are disposed a plurality of non-contiguous masking elements 30, each of which is separated from the frame 40 and from adjacent masking elements by a swath 20 wherefrom material is to removed from the surface 14 during the engraving operation. Because it is desirable to be able to select a variety of widths a swath 20, some embodiments of the invention provide a length-adjustable connecting means 44, such as the elongate metal loop 46 depicted in FIG. 8. Moreover, because it is also desirable to simulate paving stones having a variety of sizes, some embodiments of the invention provide sets of multiple masking elements 30*a*, 30*b*, 30*c*, 30*d* connected by length-adjustable connecting means 44 and shaped so that they can be drawn together or displaced some distance from each other. When spaced apart, these mask elements may be separated by a unused swath 20*a* that is not to be engraved.

Figure 9:
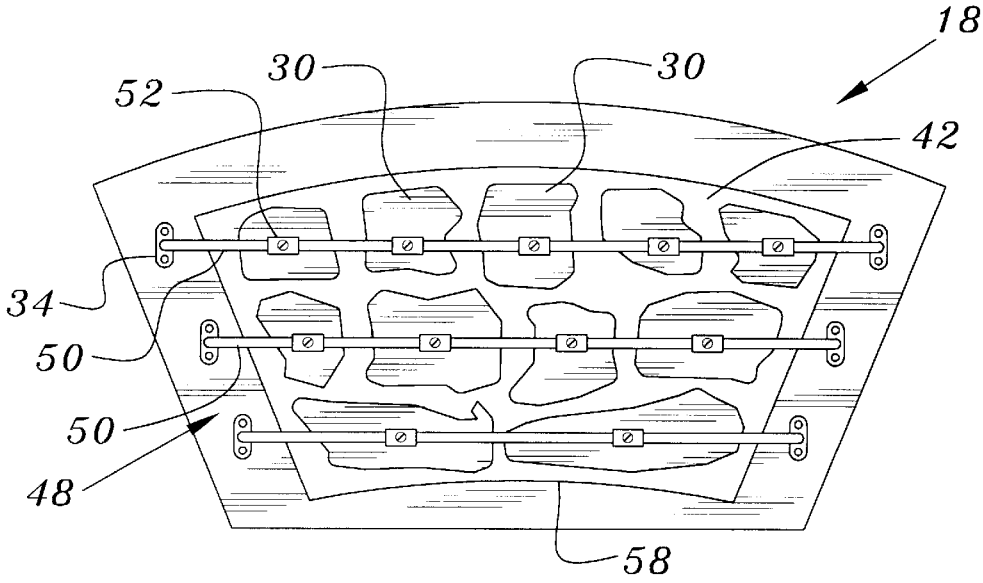
FIG. 9 is a plan view of a stencil comprising a space frame supporting non-contiguous stencil islands.

A stencil comprising an unbroken outer frame 40 allows one to use a ganged support 48 to hold several non-contiguous masking elements 30 within the frame 40. A ganged support 48, as depicted in FIGS. 1 and 9, may comprise stanchions 34 extending outwards of the distal side of the frame (i.e., that side of the frame 40 distal from the worked surface 14), and elongate supporting members 50 extending between the stanchions 34. In some embodiments commercially available plumbing pipes are used for the elongate support members 50 and oversized plumbing tees 52, retained in selected positions with set screws 54, are used to suspend individual masking elements 30 on the end of additional short pieces of piping 56. In other cases, a custom-fabricated screw-clamped fitting 53 may be used.

An additional advantage of a framed stencil is that one can select the shape of the aperture 42 so that after engraving a set of exposed swaths, the stencil 18 can be translated along the worked surface 14 and placed in a new position defining a second set of swaths, where the second set is aligned with respect to the first. For example, if one were to use a square aperture, the frame could be translated along orthogonal Cartesian axes so as to cover the worked surface with a square array of swaths. In simulating fieldstone paving, however, it has been found to be esthetically more pleasing to employ a frame 40 having a aperture 42 having four matching arcuate edges 58 that all have the same radius of curvature.

Many impacting tools 12 and tool driving means are suitable for engraving or chasing hard surfaces. These include manually and pneumatically driven single chisels, pneumatically driven sets of multiple small pointed rods or chisels of the sort commonly called "needles", as well as sand or other abrasive material carried to the working surface by air or water. Manually chasing a concrete surface in order to define a decorative pattern is generally too laborious. Sandblasting, which may use some sort of stencil, is less laborious, but tends to create a undesirably rough groove in concrete because the impacting grains of sand preferentially remove softer cement while leaving harder chunks of aggregate material exposed. Grooving a concrete surface with a single pneumatically driven chisel is also known, but tends to leave recognizable tool marks in the grooves. Hence, the preferred embodiments of the invention employ a needle scaler 60 comprising a reciprocating pneumatic hammer apparatus simultaneously reciprocating a plurality of needle-like impacting tools 12 along a predetermined stroke so as to remove many small chips of material from the worked surface without simultaneously creating an undesired texture.

Most needle scalers employ a nose 38 having a round aperture, or one in which the range of diameters 62 is relatively small—i.e., in which the aspect ratio of length to width of the aperture is less than 2:1. Although the beveled edges 24 of the stencil 18 are useful for guiding needles into a swath 20, it is nonetheless also advantageous to provide a means of forcing an array of needles into a nearly linear configuration in which the minimum width of the needle array is substantially narrower than a swath 20. In one arrangement for controllably varying the minimum width of a nosepiece of a needle scaler between an expanded configuration, in which the minimum width of the nosepiece is greater than the width of a swath, and a contracted configuration in which the minimum width of the nosepiece is less than the width of the swath, a flexible nosepiece 64 provides a means of forming a narrow needle array. In another embodiment, a flap portion 66 of an otherwise conventional steel nosepiece 68 is attached to the balance of the nosepiece by a hinge 70. With this apparatus, an operator can "pinch" the needle array into a narrow configuration, insert the nearly linear array into the swath between two neighboring masking elements and then begin chipping.

Figure 15:
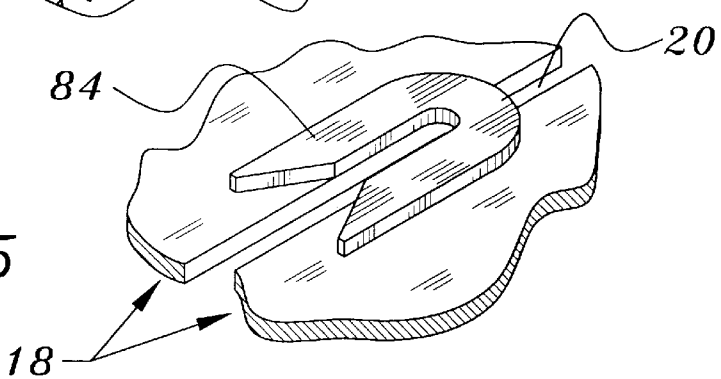
FIG. 15 is a perspective view of a stencil of the invention comprising "needle squeeze" members on a narrowing portion thereof.

Local thickness variations in a stencil 18 are also useful for realigning an array of scaler needles 22 so that all the needles impact the worked surface 26 in a narrow swath 20. For example, a locally thicker portion configured as a "squeeze chute" 84 can placed on the stencil 18 so that a bifurcating slit in the squeeze chute 84 is aligned over a portion of a swath 20 defined by a stencil 18. The squeeze chute 84 may have a funnel-like end (as depicted in FIG. 15), or may have a portion with beveled edges similar to the beveled stencil edge depicted in FIG. 1. An operator can use a squeeze chute 84 having a funnel-like opening to get all of a set of needles 22 into the narrow swath by tilting the needle scaler slightly away from a vertical setting (e.g., by 15° or so), moving the array of needles into the chute 84 and then returning the scaler to a vertical setting. Similarly, a squeeze chute having beveled edges can be used to work an array of needles into a narrow swath by lowering the needle scaler through the squeeze chute until the needles contact the surface being worked. Although the squeeze chute 84 depicted in FIG. 15 is clearly meant to be temporarily placed over a portion of the stencil when an operator wishes to work an array of needles into a narrow space, it should be noted that one could also provide squeeze chutes permanently attached to portions of the stencil. This latter approach is commonly less desirable because the increased local thickness of the stencil makes it difficult for the operator to bring the needles to bear on the edges of the swath—i.e., tilting a needle scaler away from the vertical along a line locally perpendicular to the swath is limited by the local height of the stencil.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. Engraving apparatus for engraving a first portion of a surface by driving at least one impacting tool thereinto, the engraving apparatus comprising:

means for translationally reciprocating the at least one impacting tool along a stroke having a predetermined length; and a stencil adapted to sustain an impact from the at least one impacting tool, the stencil comprising two portions disposed on opposite sides of a swath, the stencil further comprising a connecting means having two ends, each of the two ends of the connecting means attached to a respective one of the two portions.

2. The apparatus of claim 1 wherein a portion of the connecting means comprises a variable length portion.

3. The apparatus of claim 1 wherein one of the two stencil portions comprises a frame surrounding the first portion of the surface and wherein the connecting means comprises a supporting member having two ends, each of the two ends respectively attached to the frame so that the supporting member extends across the first portion of the surface.

4. Apparatus for engraving a worked surface by removing therefrom a swath of material, the apparatus comprising tool driving apparatus adapted to drive an impacting tool into the worked surface, the tool-driving apparatus comprising a nose portion;

a stencil comprising two non-contiguous stencil portions;

a connecting means having two ends, each of the two ends attached to a respective one of the two non-contiguous stencil portions so that the two non-contiguous stencil portions are spaced apart from one another on the worked surface by a width of the swath, the connecting means adapted to permit the tool driving apparatus to drive the impacting tool into that portion of the swath intermediate the two ends of the connecting means.

5. The apparatus of claim 4 wherein the connecting means extends outward from the worked surface by more than a width of the nose portion, whereby the nose portion may be inserted between the connecting means and the worked surface.

6. The apparatus of claim 4 wherein the connecting means comprises two pieces of material pivotally connected to each other so that the two portions of the stencil are adapted to conform to a non-planar surface.

7. The apparatus of claim 4 wherein the stencil further comprises a third portion spaced apart from the first and the second portions, the third portion connected to the first and to the second portions by a connecting means having three legs.

8. The apparatus of claim 4 wherein each of the two ends of the connecting means is hingedly attached to the respective stencil portion, whereby a portion of the connecting means intermediate the two ends thereof is adapted to be hingedly moved to expose that portion of the swath intermediate the two ends of the connecting means to the impacting tool.

9. Apparatus for engraving a portion of a worked surface by removing therefrom a swath of material, the apparatus comprising a stencil comprising a frame portion disposed about the portion of the worked surface, the stencil further comprising a non-contiguous portion disposed so that the non-contiguous portion and the frame portion are disposed on respective sides of the swath;

a supporting member having two ends fixedly attached to the frame so that the supporting member extends across the portion of the worked surface;

connecting means for connecting the supporting member to the non-contiguous portion of the stencil; and an engraving means for removing the material from the swath.

10. The apparatus of claim 9 wherein the connecting means pivotally attaches a non-contiguous portion of the stencil to the supporting member.

11. A combination of a needle scaler and a stencil for engraving a surface, wherein:

the stencil defines a swath having a selected swath width, and wherein the needle scaler comprises a plurality of needles extending outwardly through a nosepiece having a minimum width adapted to be controllably varied between an expanded configuration, wherein the minimum width of the nosepiece is greater than the swath width, and a contracted configuration wherein the minimum width of the nosepiece is less than the swath width.

12. The apparatus of claim 11 wherein the nosepiece comprises a hinged flap.

13. The apparatus of claim 11 wherein the nosepiece is flexible.

* * * * *